United States Patent [19]

Donnerstag et al.

[11] Patent Number: 4,795,146

[45] Date of Patent: Jan. 3, 1989

[54] TRAINING DEVICE FOR CROSS-COUNTRY SKIERS AND ICE SKATERS

[76] Inventors: Heinz Donnerstag, Trottenstrasse 22, CH-8037 Zurich; Hans-Ueli Kreuzer, CH-3984, Fiesch, both of Switzerland

[21] Appl. No.: 53,628

[22] Filed: May 26, 1987

[30] Foreign Application Priority Data

Jun. 27, 1986 [CH] Switzerland ..... 2605/86

[51] Int. Cl.[4] ..... A63B 69/18; A63B 21/02

[52] U.S. Cl. ..... 272/97; 272/138; 434/253

[58] Field of Search ..... 272/70, 96, 97, DIG. 10, 272/126, 127, 93, 135, 142, 137, 138; 128/25 R, 25 B; 434/253

[56] References Cited

U.S. PATENT DOCUMENTS

| | | | |
|---|---|---|---|
| 2,455,274 | 11/1948 | Scriver | 272/97 |
| 3,547,434 | 12/1970 | Ossenkop | 272/97 |
| 3,591,172 | 7/1971 | Hude | 272/97 |
| 3,650,528 | 3/1972 | Natterer | 272/97 |
| 3,807,727 | 4/1974 | Fergnson | 272/97 |
| 4,340,214 | 7/1982 | Schutzer | 272/97 |
| 4,396,189 | 8/1983 | Jenkins | 272/97 |
| 4,679,786 | 7/1987 | Rodgers | 272/70 |

FOREIGN PATENT DOCUMENTS

| | | | |
|---|---|---|---|
| 269206 | 2/1951 | Switzerland | 272/97 |
| 481658 | 1/1970 | Switzerland | 272/97 |
| 193975 | 8/1967 | U.S.S.R. | 272/97 |
| 1049071 | 10/1983 | U.S.S.R. | 272/97 |
| 1175511 | 8/1985 | U.S.S.R. | 272/97 |

OTHER PUBLICATIONS

Bachler—"Bbe Skate"—Applicant's Exhibit D filed in Paper No. 4, 1-7-88.

*Primary Examiner*—V. Miller
*Assistant Examiner*—J. R. Crow
*Attorney, Agent, or Firm*—Bernard, Rothwell & Brown

[57] ABSTRACT

An apparatus for training cross-country skiers and ice skaters has a frame having a center support and two bars, the rear ends of which are connected to said frame in such a manner as to be pivotable about vertical axes. The center support and the bars have respective standing surfaces with threaded bores of the attachment of cross-country ski bindings. The bars are held together by at least one spring and support rollers on their forward ends which rotate about horizontal axes. The hip muscles, thigh extensors and gluteal muscles can be exercised with this apparatus.

6 Claims, 1 Drawing Sheet

TRAINING DEVICE FOR CROSS-COUNTRY SKIERS AND ICE SKATERS

SUMMARY OF THE INVENTION

The object of the present invention is to create a training apparatus for cross-country skiers and ice skaters by means of which primarily the hip muscles, i.e., the hip-thigh flexor, the thigh extensor and the gluteal muscles are exercised. This object is achieved by means of the distinguishing characteristics of claim 1.

DETAILED DESCRIPTION OF THE PREFERRED EMBODIMENT

Figures 1, 2, 3, 4:
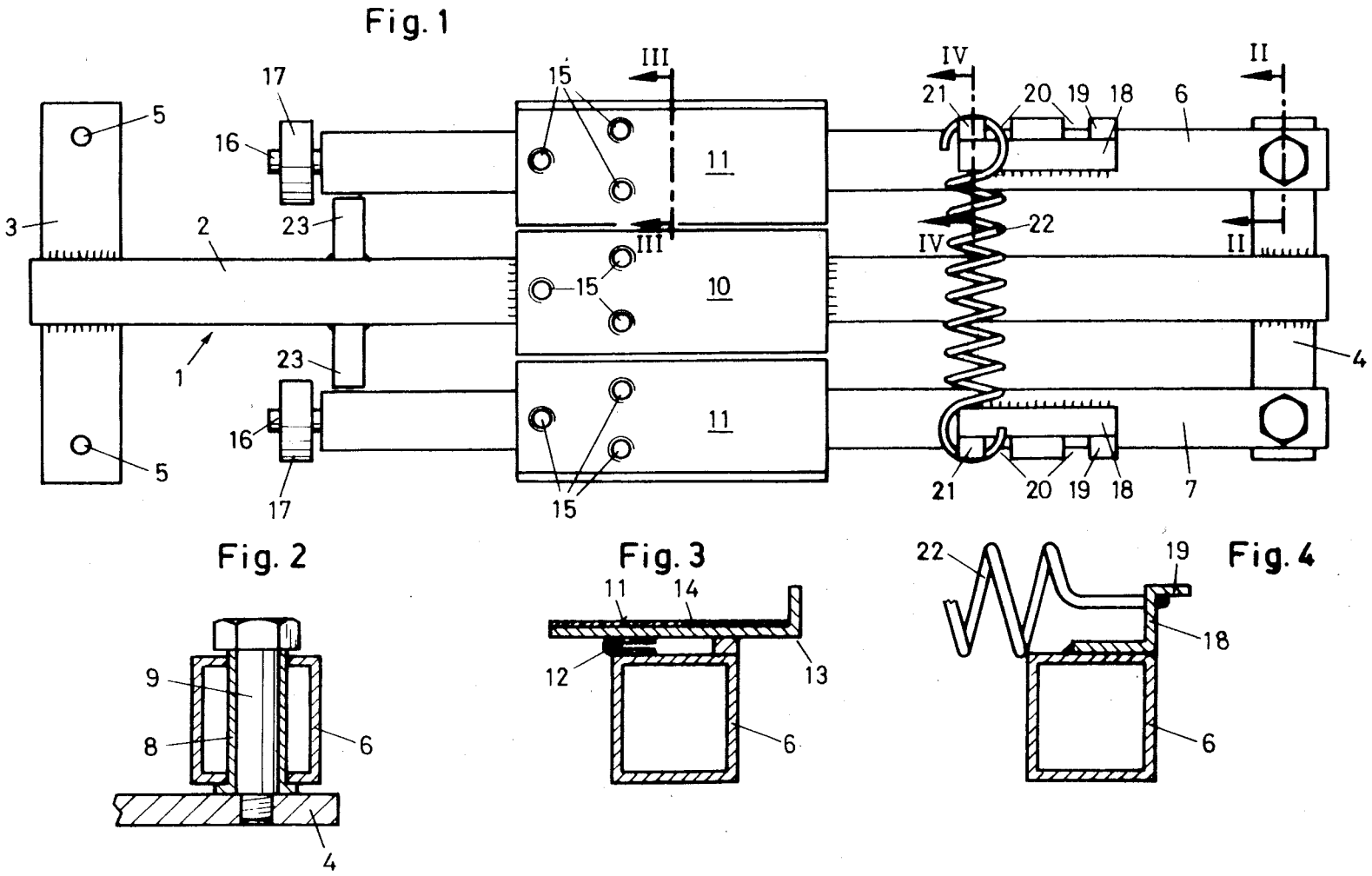
FIG. 1 is a top view of the apparatus.
FIG. 2 is a cross section along the line II—II of FIG. 1.
FIG. 3 is a cross section along the line III—III of FIG. 1.
FIG. 4 is a cross section along the line IV—IV of FIG. 1.

An exemplary embodiment of the invention is described with the aid of the drawing.

The illustrated apparatus includes a frame 1 having a center support 2 formed as a four-sided pipe and two support feet 3, 4 welded thereto. The forward support foot 3 has two attachment bore 5 for screwing the frame to the floor. Two bars 6, 7 formed from four-sided pipes are attached to the rear support foot 4 so as to pivot about vertical axes. For this purpose respective brass sleeves 8 are pressed into the rear ends of the bars 6, 7 and are rotatably mounted with bolts 9 threaded into the support leg 4 (FIG. 2).

Respective standing surfaces 10, 11 are mounted on the center support 2 and on the two bars 6, 7 at equal distances from the support foot 4. The standing surface 10 is welded to the center support 2, while the standing surfaces 11 are hinged to the bars 6, 7 by means of hinges 12 running along the upper inside edges of the bars 6, 7 (FIG. 3). Each of the standing surfaces 11 consist of a bent sheet 13 that is spot-welded to the hinges 12 and a rubber covering 14. Each of the standing surfaces 10, 11 has three threaded bores 15 for the mounting of a cross-country ski binding.

At their forward ends, the bars 6, 7 each support a horizontal axis 16, on which a roller 17 is rotatably mounted. The forward end of the bars are supported on the floor by means of these rollers. A member 18 having a Z-shaped cross section with upwardly and outwardly projecting free shanks 19 is welded to the bars 6, 7 behind the standing surfaces 11. Two openings 20 are milled from the shank 19 into the web of the Z-shaped cross-sectional member 18. In this manner, two hooks 21 are formed to support springs 22. For this purpose, two springs 22 of different spring strengths are provided in order to adapt the training to individual requirements. Instead of or in addition to the spring 22, a hydraulic or pneumatic cushion can also be suspended from the second hook 21. To limit the movement of the bars 6, 7 in their normal position parallel to the center support 2, two stop blocks 23 are welded to the center support 2.

In operation, respective cross-country ski bindings are screwed to the standing surfaces 10, 11. The cross-country skier or ice skater steps into the bindings and then rhythmically pivots either one bar 6 with one foot, or alternately moves both bars 6, 7 with both feet, against the force of the spring 22. The spacing of the standing surfaces 10, 11 from the pivot axes 9 is selected in such a manner than the pivot movement approximates the natural cross-country ski-skating or ice skating step. Due to the pivoting motion of the standing surfaces 11 parallel to the longitudinal bar axes, the natural foot position can be maintained.

What is claimed is:

1. A training apparatus for cross-country skiers and ice skaters comprising; a frame for setting up on the floor, two elongated bars pivotably supported on the frame at their rear ends with respect to a trainee's orientation, to allow each bar to pivot about a vertical axis, each bar having a standing surface for a trainee, an axle parallel to the longitudinal direction of the respective bar and a wheel supporting the bar at its front end and rotatable about said axle, spring biasing means biasing the two bars toward each other, and stop means on the frame for retaining one of the bars while the other bar is swung away from the retained bar against the action of the spring means, wherein each standing surface is pivotable about an axis parallel to the longitudinal direction of the respective bar.

2. Apparatus according to claim 1, wherein the stop means are arranged on an elongated center support of the frame, the two bars in their neutral position being symmetrical to a vertical plane containing a longitudinal axis of the center support.

3. Apparatus according to claim 1, wherein each standing surface has means for attachment of a cross-country ski boot binding means.

4. A training apparatus for cross-country skiers and ice skaters comprising; a frame for setting up on the floor, two elongated bars pivotably supported on the frame at their rear ends with respect to a trainee's orientation, to allow each bar to pivot about a vertical axis, each bar having a standing surface for a trainee, an axle parallel to the longitudinal direction of the respective bar and a wheel supporting the bar at its front end and rotatable about said axle, spring biasing means biasing the two bars toward each other, and stop means on the frame for retaining one of the bars while the other bar is swung away from the retained bar against the action of the spring means, the stop means being arranged on a center support of the frame, the two bars in a neutral position being symmetrical to a vertical plane containing a longitudinal axis of the center support, wherein the stop means are mechanical stops against which the bars abut in their neutral position.

5. Apparatus according to claim 4, wherein a further standing surface is mounted on the center support at approximately the same distance from the pivot axes as the standing surfaces of the bars.

6. A training apparatus for cross-country skiers and ice skaters comprising; a frame for setting up on the floor, two elongated bars pivotably supported on the frame at their rear ends with respect to a trainee's orientation, to allow each bar to pivot about a vertical axis, each bar having a standing surface for a trainee, an axle parallel to the longitudinal direction of the respective bar and a wheel supporting the bar at its front end and rotatable about said axle, spring biasing means biasing the two bars toward each other, and stop means on the frame for retaining one of the bars while the other bar is swung away from the retained bar against the action of the spring means, wherein each standing surface is pivotable about an axis parallel to the longitudinal direction of the respective bar between two end positions one of which end positions being where the standing surface is horizontal.

* * * * *

UNITED STATES PATENT AND TRADEMARK OFFICE

CERTIFICATE OF CORRECTION

PATENT NO. : 4,795,146

DATED : January 3, 1989

INVENTOR(S) : Heinz Donnerstag, et al.

It is certified that error appears in the above-identified patent and that said Letters Patent is hereby corrected as shown below:

Front Page, Column 2, line 14, "Miller" should be -- Millin --;

Front Page, Column 2, line 15, "J" should be -- S --.

Column 1, line 28, "bore" should be -- bores --.

Column 2, line 2, "than" should be -- that --.

Signed and Sealed this

Twenty-third Day of January, 1990

*Attest:*

JEFFREY M. SAMUELS

*Attesting Officer* *Acting Commissioner of Patents and Trademarks*